United States Patent [19]

Geiger

[11] 3,974,991

[45] Aug. 17, 1976

[54] RAILROAD MOTION DETECTING AND SIGNALLING SYSTEM WITH REPEATER RECEIVER

[75] Inventor: Willard L. Geiger, Chagrin Falls, Ohio

[73] Assignee: Erico Rail Products Company, Solon, Ohio

[22] Filed: Aug. 27, 1975

[21] Appl. No.: 608,085

[52] U.S. Cl. ..... 246/34 CT; 246/114 R; 246/125

[51] Int. Cl.[2] ..... B61L 21/06

[58] Field of Search ..... 246/121, 125, 128, 130, 246/34 R, 34 CT, 40, 111, 113, 114 R; 235/150.2, 150.24

[56] References Cited

UNITED STATES PATENTS 3,422,262 1/1969 Brockman ..... 246/34 R

*Primary Examiner*—Trygve M. Blix
*Assistant Examiner*—Reinhard J. Eisenzopf
*Attorney, Agent, or Firm*—Warren A. Sklar; D. A. N. Chase

[57] ABSTRACT

A first transmitter-receiver movement detector system operable at a first frequency detects a train approaching a first grade crossing or other track location in response to train approach speed and distance, and a repeater receiver movement detector device also operable at such first frequency but located at a subsequent grade crossing or location, which is relatively proximate the first, is capable of looking through the first crossing even under unfavorable ballast conditions thereat to detect an approaching train with respect to its speed and distance from the second crossing. The output of the repeater receiver and that of a further transmitter-receiver movement detector system operable at a different frequency from the first are combined in a logic circuit to provide safe, minimum signal down time at the subsequent location.

18 Claims, 6 Drawing Figures

RAILROAD MOTION DETECTING AND SIGNALLING SYSTEM WITH REPEATER RECEIVER

BACKGROUND OF THE INVENTION

This invention relates to a system for signalling the approach of a train on a track and, more particularly, this invention is directed to a system for effecting operation of respective signalling devices at plural relatively proximate grade crossings to indicate the approach of a train. Moreover, the invention relates to a railroad signal system including a repeater receiver device between two spaced apart locations for looking through a first one of the locations to detect a train approaching both the first and the subsequent locations.

The invention will be described with reference to a system that produces a system output signal to effect pick up or dropping of the conventional railroad signal relay at a grade crossing, which will in turn effect pick up or dropping of the crossing gate, or de-energization or energization of a signal light, bell or the like, to signal street traffic whether or not a train is approaching the crossing. The railroad signal relay arrangement provides electrical isolation between the relatively low voltage railway signal system and the high voltage usually required for energization of the crossing gate operating motor, signal lamps or the like, and also provides a measure of safety whereby a failure in the railway signal system eliminating its output will result in dropping of the signal relay —i.e., failure is in what is referred to as a safe direction. However, it is to be understood that the system output signal can be used as an input to effect operation of other signalling devices, computers for monitoring, control and similar functions and the like. Moreover, although the invention will be described with reference to signalling at a grade crossing, the system also may be used for block signal control and the like.

Many of the prior art railway signal systems currently used to protect grade crossings at which a street and a railroad track cross on the same level or grade respond only to the presence of the train in the predetermined island or approach that is often required to be electrically isolated from other parts of the track by sets of insulated joints at both ends of the island or approach. These existing signal systems may respond only to a train located within the island between the transmitter and receiver tie points to the track and, thus, require long islands to provide train detection within a safe time before the train arrives at the grade crossing. Such a long island increases the difficulty of the system installation and maintenance, and such systems may effect undesirably long down times of the signal device, which is dropped when the train enters the approach or island regardless of the train speed. Other systems that respond to train approach speed, but do not include variable sensitivity features that correlate approach speed with distance from the crossing, often require plural electrical systems operating at different frequencies for achieving a minimum safe down time of the signal device.

One disadvantage with prior art railway signal systems is that without variable sensitivity, a train consisting of only a single car and/or engine may accelerate after approach time prediction to put the engine almost in the crossing before gate actuation. Another disadvantage is the relatively long ring-by time usually experienced in prior art railway signal systems, which is a nuisance to motorists. Moreover, the effectiveness of the prior art systems over a wide range of track ballast conditions is limited.

In my U.S. Pat. No. 3,850,390, issued Nov. 26, 1974, and in my U.S. Patent Applications Ser. No. 458,172, filed Apr. 5, 1974, now Pat. No. 3,929,307 and Ser. No. 568,565, filed Apr. 16, 1975, which patent and patent applications are assigned to the same assignee as the present application, are disclosed movement detector railway signal systems that include a variable sensitivity feature. The mentioned feature effects a correlation between the speed of the approaching train and the distance of the approaching train from the island defined by the system tie points to the track proximate opposite sides of the grade crossing in order that a system output signal indicative of an approaching train is produced to effect dropping of the railroad signal relay a sufficiently safe time in advance of the arrival of the train at the crossing without an unnecessarily long down time. These movement detector systems are capable of responding to the approach of a train by monitoring the dynamic affect of the approaching train on signals transmitted in the track.

The movement detector railway signal systems disclosed in my above-mentioned patent and patent applications are responsive to changes in the lumped impedance along a portion of a track, especially changes caused by a train approaching the system tie points to the track. These movement detector systems usually include a transmitter and a receiver that are coupled to the track on opposite sides of and proximate to a grade crossing, for example, so as to have a relatively short island. However, the systems are capable of transmitting their electrical signals in the track for several thousand feet in each direction from the island and, therefore, are able to look down the track in both directions to see whether or not a train has entered the monitored, and not necessarily insulated, approach. After a train has entered the approach, the systems automatically correlate the train approach speed and distance from the grade crossing so as to effect dropping of the railway signal relay at a safe, but not too advanced, time before arrival of the train at the crossing.

Each of the movement detector railway signal systems operates on AC signals, and usually successive grade crossings, for example, along a common track may be protected by different respective systems operating at different frequencies without encountering detrimental interference between the systems. When two grade crossings are proximate each other, for example, wherein the respective approaches to each overlap, it will be necessary for at least one of the movement detector systems to "look through" the adjacent crossing to detect an approaching train sufficiently in advance of its arrival at the subsequent crossing. This approach overlap is not usually a problem if the two signal systems operate on sufficiently different frequencies.

It has been found, however, that an unusually large lump of impedance may be created at a grade crossing when salt is spread to melt ice or snow on the street, for example. Such a large lump of impedance may block the signal transmitted in the track by the movement detector system connected at a proximate subsequent grade crossing, thus preventing such movement detector system from "looking through" the first-mentioned grade crossing to detect an approaching train.

The problem encountered when such a large signal blocking lump of impedance occurs may be a too short warning time at the subsequent crossing, for example, assuming a first crossing and a second or subsequent crossing are located one thousand feet apart along a railroad track and trains run on the track often at speeds of 60 miles per hour 100 kilometers per hour) only in one direction, whereby they would arrive at the first crossing before arriving at the second. A first movement detector system having its transmitter and receiver connected to the track on opposite sides of the first crossing protects the same by effecting dropping of the railroad signal relay thereat a safe time prior to the arrival of an approaching train at such first crossing, and a second movement detector is similarly coupled to the track at the second crossing for protection of the second crossing. In order for the second movement detector system to provide more than an eleven or twelve second warning time prior to the arrival of the approaching train at the subsequent crossing, it is necessary for the second movement detector system to transmit effectively its signal beyond the first crossing. Although under normal track ballast conditions there is usually no problem for the second movement detector system to look through the firsts crossing, an unusually large lump of impedance at the first crossing substantially blocking the signal of the second movement detector system from passing therethrough would permit the second system to detect the train only after it had passed the first crossing resulting in a too short 11 or 12 second warning prior to arrival of a train approaching at a speed of sixty miles per hour.

SUMMARY OF THE INVENTION

The railroad signal system of the invention detects a train approaching at least two spaced apart locations with respect to the train speed and distance from the locations. The system includes a transmitter-receiver, which may be similar to the movement detector systems disclosed in my above-mentioned patent and patent applications, at a first location for detecting an approaching train in response to changes in a signal representative of the approaching train speed and distance from the first location. A repeater receiver between the first location and a subsequent location responds to the signal developed by the transmitter of the transmitter-receiver and is therefore capable of looking through the first location even under unfavorable ballast conditions to detect such an approaching train in response to changes in that signal representative of the approaching train speed and distance from the subsequent location. The gain of the repeater receiver is preferably adjusted to a relatively high level so that it will effectively ignore the affect of the ballast impedance to a point just beyond the first crossing, preferably to the point that the transmitter is tied to the track, and so that it will effectively detect an approaching train safely in advance of arrival at the subsequent crossing.

A further transmitter-receiver device, similar to the first but operable at a different frequency, may be located at the subsequent location normally to detect a train approaching the second location in response to changes in a signal developed by the transmitter thereof representative of the approaching train speed and distance from the subsequent location. However, the further transmitter-receiver device may not be able to look through the first location when an unfavorable ballast condition exists at such first location. Therefore, the above-mentioned repeater receiver and the further transmitter-receiver may be coupled by a logic circuit to ensure signalling that a train is approaching the subsequent location sufficiently in advance of the train arrival thereat. The logic circuit also avoids unnecessary signalling of such an approaching train in the event the train stops between the first and subsequent locations.

The present invention may be used to protect successive grade crossings, for example, located in relative proximity to each other along a railroad track so as to effect a signalling function at the respective grade crossings indicative of the train approaching the crossings. If trains move on the track only in one direction, then the first grade crossing reached by the train usually would only require a transmitter-receiver device to detect the train. At the second grade crossing both a repeater receiver device operable at the same frequency as the first-mentioned transmitter-receiver device and a second transmitter-receiver device will operate, sometimes in a duplicative manner, to detect the train approaching the second grade crossing. In the event that trains move in both directions on the track, then it may be desirable also to use a repeater receiver device at the first grade crossing, which device would be operable at the frequency of the second-mentioned transmitter-receiver device.

Accordingly, it is a primary object of the invention to detect a train approaching at least two spaced apart locations even under relatively unfavorable ballast conditions at the first location to effect a safe, preferably minimum, signalling or down time at each location.

A further object of the invention is to look through a lump of impedance at a first location to detect a train approaching both the first and a subsequent location.

Another object of the invention is to provide a safe warning time at relatively proximate railroad grade crossings during which respective signals are produced to indicate a train approaching the respective grade crossings.

An additional object of the invention is to provide a repetitive system for detecting a train approaching a second of two relatively proximate spaced apart locations and more particularly, to combine the outputs of such repetitive devices to provide for dominant control by one of them.

These and other objects and advantages of the present invention will become more apparent as the following description proceeds.

To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 6 is a schematic electric circuit diagram of a repeater receiver used in the system shown in FIG. 1.

DESCRIPTION OF THE PREFERRED EMBODIMENT

The railroad signal system of the present invention will be described hereinafter specifically to provide respective output signals at two spaced apart grade crossings in order to effect a signalling function at each crossing indicative of a train approaching the crossings. Accordingly, the system output signals are used to control operation of a typical railroad signal relay, which in turn operates a warning device, such as a crossing gate, signal light or bell. A non-zero system output signal may be used to effect pick up of the railroad signal relay that also picks up the crossing gate or de-energizes the warning light or bell, implying that no train has been detected approaching the grade crossing. On the other hand a zero system output signal allows the railroad signal relay to drop, which causes the warning device to operate to warn that a train is approaching the crossing. Thus, a zero system output signal is a signal indicative of an approaching train.

It is to be understood, as mentioned above, that the railroad signal system of the invention may be used to produce other types of output signal indicative of whether or not a train has been detected approaching a given location to effect operation of other signalling devices, computers for automated train control or the like, and so on. Moreover, the railroad signal system of the invention may be used for block signal control as well as for other application wherein it is desired to detect a vehicle approaching a plurality of successive spaced apart locations.

Figure 1:
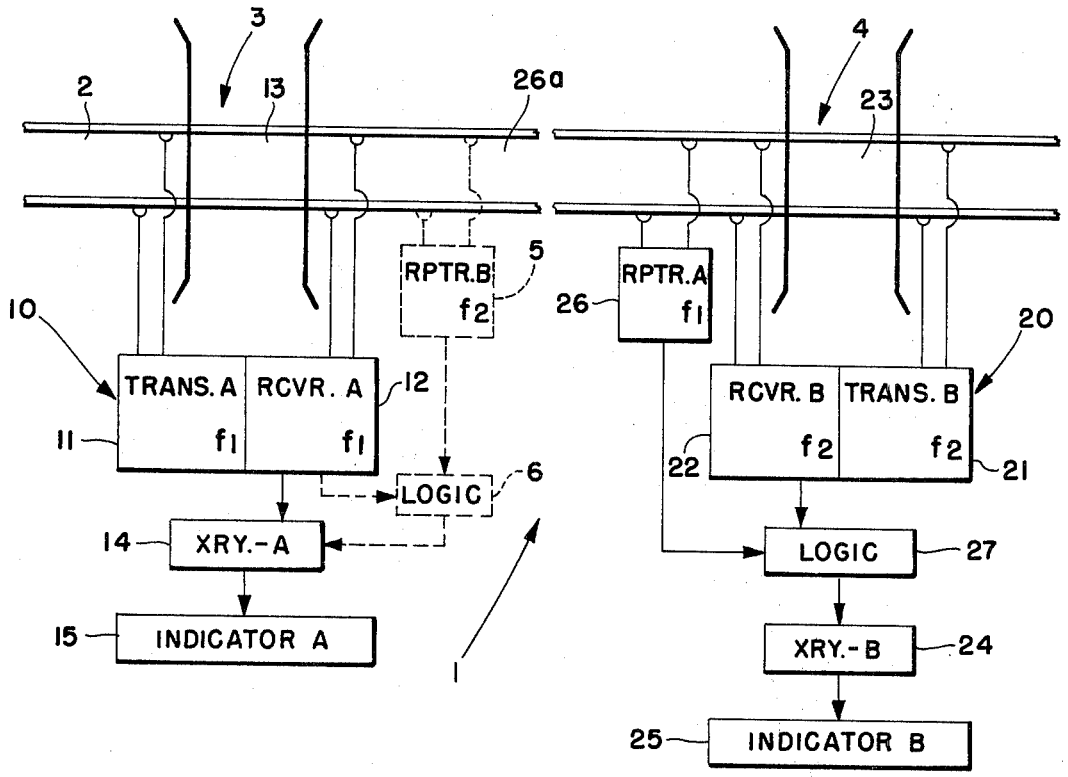
FIG. 1 is a schematic illustration in block form of a railroad signal system in accordance with the invention to detect a train approaching two spaced apart grade crossings.

Referring now to the drawings, and particularly to FIG. 1, a complete railroad signal system for detecting a train approaching two spaced apart grade crossings located along a railroad track is generally indicated at 1. The system 1 will be described hereinbelow with reference to use to detect a train approaching from the left along the track 2, whereby the train will arrive at the first grade crossing 3 before it arrives at the subsequent grade crossing 4. With such a singular train movement direction in mind, the system 1 is shown in a solid line block diagram, and the invention will be described in detail with reference to such condition. On the other hand, if trains normally move on the track 2 in both directions, the system 1 may include an additional repeater receiver 5 and logic circuit 6 which are shown in dotted outline, as will become clearer from the following description.

The railroad signal system 1 includes a first or A transmitter-receiver device 10, which comprises a transmitter 11 and a receiver 12 that are coupled to the track 2 on opposite sides of the first grade crossing 3 to define an island 13 between the system tie points to the track. The transmitter preferably develops an interrupted AC carrier wave signal of a first frequency $f_1$ and of the shape illustrated in FIG. 4 that is transmitted in the track as a first track signal, and the receiver 12 responds to that first track signal and particularly to attenuation thereof by the wheels and axle of an approaching train so as to effect a system output signal that controls the A railroad signal relay 14. When the system output signal from the receiver 12 is non-zero, the railroad signal relay 14 will be picked up, and the A indicator device 15, such as a crossing gate or the like, also will be picked up. On the other hand, when a zero output signal is produced by the receiver 12, the railroad signal relay 14 and the indicator 15 will be dropped to provide a warning indication or signal at the first grade crossing 3 of the forthcoming arrival of an approaching train.

A second or B transmitter-receiver device 20, which includes a transmitter 21 and a receiver 22, is similar in construction and operation to the first transmitter-receiver device 10, except that the frequency $f_2$ of the second track signal developed by the transmitter 21 and to which the receiver 22 responds is different than and preferably non-interfering with the frequency $f_1$ of the first transmitter-receiver device 10. The transmitter 21 and receiver 22 are coupled to the track 2 on opposite sides of the subsequent grad crossing 4 to define an island 23.

Under relatively normal track ballast conditions the transmitter 21 is capable of transmitting its interrupted AC carrier wave track signal through the track 2 an appreciable distance beyond the first grade crossing 3, and the receiver 22 also ordinarily will be capable of detecting changes effected in that signal by the variable shunt caused by an approaching train. Therefore, under relatively normal track ballast conditions the receiver 22 will be capable of looking through the first crossing 3 to detect an approaching train depending on the train speed and its distance from the subsequent grade crossing 4. The receiver 22 produces an appropriate system output signal depending on whether or not an approaching train has been detected to control the B railroad signal relay 24 and the B indicator device 25.

The first and second transmitter-receiver devices 10, 20 may be similar to the transmitter and receiver devices disclosed in my above-mentioned patent and copending patent applications. Such a transmitter-receiver device has a variable sensitivity feature enabling it to correlate the train speed and distance from the respective islands or system tie points to the track so that a safe, but not too long, warning is given at the respective grade crossings to indicate the forthcoming arrival of an approaching train. In operation of the two transmitter-receiver devices 10, 21, then, as a train approaches the first and subsequent grade crossings 3, 4 from the left, the first transmitter-receiver device 10 will usually be the first to detect an approaching train and to effect a system output signal and a warning at the first crossing indicative thereof. A short time later, depending upon the distance between the two grade crossings and the train approach speed, the second transmitter-receiver device 20 will also detect the approaching train to effect an appropriate warning at the subsequent grade crossing 4.

In the event of the occurrence of an unfavorable ballast condition at the first grade crossing 3, for example caused by salting the highway at the grade crossing to melt ice or snow, the signal transmitted in the track by the transmitter 21 may become so attenuated as not to permit the receiver 22 to detect an approaching train located to the left or beyond the first grade crossing 3. Therefore, an A repeater receiver 26 located between the two grade crossings 3, 4 and preferably coupled or tied to the track proximate the subsequent grade crossing defining a relatively long uninsulated island 26*a* up to the transmitter 11 track tie point is tuned to the first frequency $f_1$ to receive the first track signal developed by the transmitter 11. The circuitry of the repeater receiver 26 is similar in construction and operation to the circuitry of the receiver 12 and is capable of responding to changes in the first track signal caused by the moving shunt affect of an approaching train so as to produce an output signal that is related to the train approach speed and its distance from the transmitter tie point 11 to the track, plus the distance of the island 26*a* between such tie point and the tie point of the repeater receiver to the track.

By turning up the gain of the repeater receiver 26 relative to the gain of the receiver 12, the repeater receiver may effectively ignore or compensate for the lumped ballast impedance of the island 26*a* and, therefore, be capable of satisfactorily detecting the motion of an approaching train. Moreover, since the magnitude of the first track signal is relatively large at its point of input to the track 2 from the transmitter 11 the attenuation thereof caused by an unfavorable ballast condition at the first grade crossing 3 will not detrimentally affect the ability of the repeater receiver 26 to respond to changes in that signal to detect a train well beyond, i.e., to the left of the first grade crossing 3 depending on the train speed and distance.

The outputs from the receiver 22 and a repeater receiver 26 may be combined in a logic circuit arrangement 27 in a manner to be described in more detail below to provide a combined system output signal control for the railroad signal relay 24 and indicator device 25. In any event, if the receiver 22 has not first detected train, a zero output signal from the repeater receiver 26 will operate through the logic circuit 27 to drop the a train, signal relay 24. If desired, the repeater receiver 26 may be used to operate the railroad signal relay 24 directly.

Actually the operative railroad signal system of the invention may be considered to be the A sub-system, including the transmitter-receiver device 10 and the repeater receiver 26 which operate on the interrupted AC carrier wave signal of the first frequency $f_1$. This A sub-system will be operative to detect the motion of a train approaching from the left so as normally to effect sequential dropping of the railroad signal relays 14 and 24 at times determined by the train speed and its respective distances from the two crossings 3 and 4. By combining the functions of the repeater receiver 26 and transmitter-receiver device 20 of the B sub-system, for example using the logic circuit 27, a repetitive or duplicative control of the railroad signal relay 24 is achieved, thus increasing the effective operation of the combined or complete railroad signal system 1.

Amplifying now on the operation of the railroad signal system 1, the first transmitter-receiver device 10 will be capable of detecting an approaching motion of a train a sufficient time in advance of its arrival at the first grade crossing 3 in order to provide a safe advance warning to vehicular and pedestrian traffic on the highway at the first grade crossing. If the track ballast condition at the first grade crossing 3 is relatively normal, then the second transmitter-receiver device 20 also will detect the approaching train motion to effect a safe advance warning via the logic circuit 27 at the subsequent grade crossing 4. However, under unfavorable ballast conditions at the first grade crossing, for example, due to a salted highway, causing the second transmitter-receiver device 20 to be incapable of looking through the first grade crossing to detect the approaching train or if no second transmitter-receiver device were used the repeater receiver 26 would be capable of effectively bypassing the first grade crossing 3 or to look through the same to detect the approaching train motion before the train arrives at the first grade crossing. Upon such train detection by the repeater receiver 26, the latter will produce an output signal operable through the logic circuit 27 to effect a system output signal control that drops the railroad signal relay 24.

Figure 2:
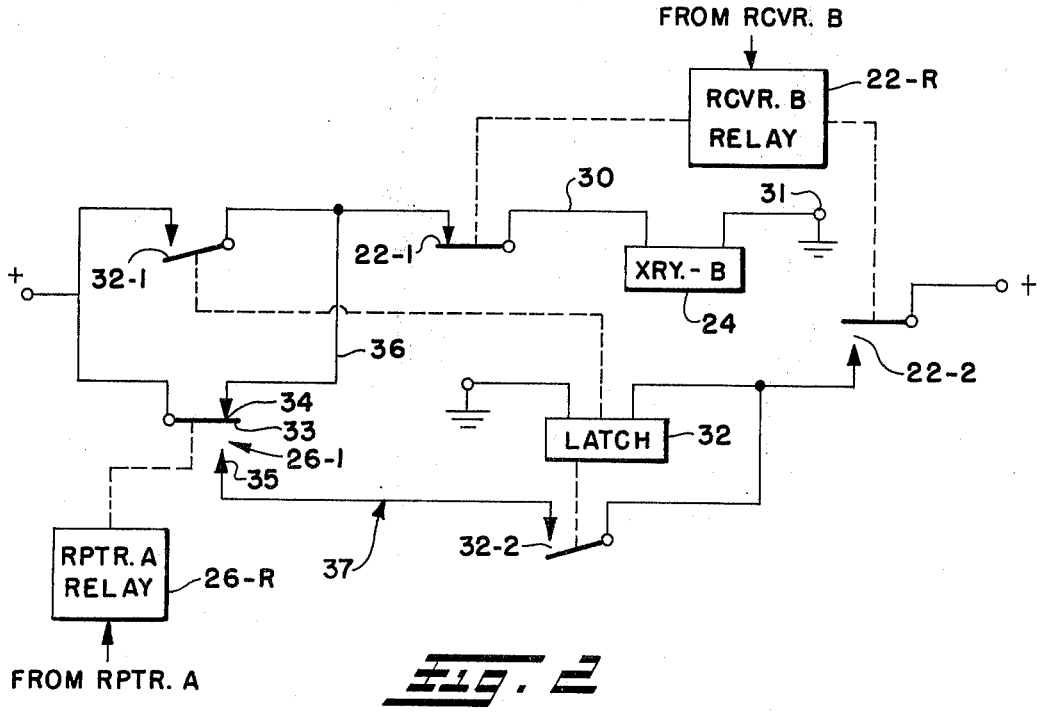
FIG. 2 is a schematic illustration of a logic circuit for use in the system shown in FIG. 1 to combine the outputs of a receiver and a repeater receiver at a common grade crossing.

Although the railroad signal relay 14 may be controlled directly by the output of the receiver 12, it is the logic circuit 27, which is shown in detail in FIG. 2, that is directly controlled by the outputs of the repeater receiver 26 and the receiver 22, and the output of the logic circuit 27 directly controls the railroad signal relay 24. The logic circuit 27, and similarly the logic circuit 6 if used, will drop the railroad signal relay 24 upon first detection of the motion of an approaching train by either the repeater receiver 26 or the receiver 22. Moreover, after the motion of an approaching train has been detected by the receiver 22, the logic circuit 27 functions to prevent itself from responding to the repeater receiver 26 output signal unless both the repeater receiver 26 and the receiver 22 simultaneously produce non-zero output signals indicative of no train detection. It will be appreciated that while the logic circuit 27 is shown and described with reference to electric relay logic, equivalent electronic logic, for example using logic gates, alternatively may be employed.

As illustrated more comprehensively in FIG. 2, the railroad signal relay 24 is coupled to the logic circuit between an output line 30 from the latter and a ground or neutral terminal 31. DC power is supplied to the logic circuit 27 at the labelled positive and ground terminals, for example, from a DC supply, not shown. If desired, the logic circuit 27 may be modified to operate on AC power. The logic circuit 27 includes a pair of switches 22-1 and 22-2 controlled by an output relay 22-R responsive to the output signal from the receiver 22, and a single pole, double throw switch 26-1 controlled by an output relay 26-R responsive to the output signal from the repeater 26, a latch relay 32, and further pair of switches 32-1, 32-2 operated by the latch relay. Each of the switches in the logic circuit 27 may be respective contacts that are opened or closed in response to operation of the respective relays 22-R, 26-R and 32.

The several switches in the logic circuit 27 of FIG. 2 are shown in their normal respective open and closed positions when neither the receiver 22 nor the repeater receiver 26 has detected an approaching train, and, thus, both then produce non-zero output signals picking up output relays 22-R and 26-R. However, when the receiver 22 detects an approaching train or otherwise produces an output, such as a zero output signal, indicative of an approaching train, the output relay 22-R is dropped to open the switch 22-1 and close the switch 22-2. When the repeater receiver 26 detects an approaching train the repeater output relay 26-R is dropped to operate the switch 26-1 moving the switch arm 33 thereof from engagement with the upper contact 34 downward into engagment with the lower contact 35 thereof. Whenever the latch relay 32 is energized, the switches 32-1 and 32-2 are closed thereby.

In operation of the logic circuit 27 to combine the outputs from the receiver 22 and the repeater receiver 26 to control the railroad signal 24 initially when neither the receiver 22 nor the repeater receiver 26 has detected an approaching train, the respective switches in the logic circuit 27 will be as shown in FIG. 2. Accordingly, the railroad signal relay 24 will be picked up by a closed power circuit thereto from a positive terminal to the neutral terminal 31 via switch 26-1, line 36, switch 22-1 and output line 30.

The repeater receiver 26 normally will detect a train approaching from the left before the receiver 22 detects that train, and upon such detection by the repeater receiver output relay 26-R is dropped moving the switch arm 33 from engagement with its upper contact 34 to its lower contact 35, thus opening the original power circuit to the railroad signal relay 24. The dropped railroad signal relay 24 will effect operation of the indicator device 25 at the subsequent grade crossing 4 signalling vehicular and pedestrian traffic that a train is approaching the crossing.

At some time after the repeater receiver 26 has detected an approaching train, the receiver 22 also will detect the motion of the approaching train and will drop its output relay 22-R opening the switch 22-1 ensuring that the railroad signal relay 24 remains dropped and closing the switch 22-2 effecting energization of the latch relay 32. Such energization of the latch relay 32 effects closure of the switch 32-2 to self-energize the latch relay 32 maintaining the same energized until the repeater receiver 26 again picks up its output relay 26-R upon receiving an appropriate signal from the transmitter 11, for example after the train has left the island 26*a* moving in a direction to the right with reference to FIG. 1. Energization of the latch relay 32 to close switch 32-1 will affect a bypass of the switch 26-1 in the power circuit to the railroad signal relay 24, thus making the latter then responsive only to the receiver 22 until both the receiver 22 and the repeater receiver 26 recover and pick up their output relays 22-R and 26-R.

Assuming no train has been detected by the receiver 12, the receiver 22 or the repeater receiver 26, there will be no warning signal initiated at either of the grade crossings 3 or 4, and the logic circuit 27 will be in the condition shown in FIG. 2. As a train approaches the two grade crossings from the left-hand direction, the receiver 12 will first detect the motion of the approaching train and will drop the railroad signal relay 14 to effect a warning signal at the first grade crossing 3. The repeater receiver 26 will subsequently detect the motion of the approaching train, possibly before the train arrives at the first grade crossing 3, depending on the distance between the two grade crossings and the train speed. Upon such detection the repeater receiver drops its output relay 26-R throwing the switch 26-1 to its opposite condition to open the power circuit to the railroad signal relay 24 and to condition a self-energization circuit for the latch relay 32 via line 37. A warning signal is then produced at the subsequent grade crossing 4 by the indicator device 25.

As the train continues to approach the subsequent grade crossing 4, the receiver 22 will detect the approaching motion of the train and will drop its output relay 22-R opening switch 22-1 to ensure cut-off of the power circuit to the railroad signal relay 24 and closing switch 22-2 to energize the latch relay 32. Closure of the switch 32-2 by the energized latch relay 32 provides a self-energization circuit for the latch relay maintaining the same energized until the repeater receiver recovers and picks up output relay 26-R upon detection of a signal transmitted by the transmitter 11. Moreover, closure of the switch 32-1 by the energized latch relay 32 provides a bypass of the switch 26-1 in the railroad signal relay power circuit so that in case a train stops between the two grade crossings and, more specifically, in the island 26*a*, the railroad signal relay 24 will be only under control by the receiver 22.

Therefore, if such a train stoppage were to occur, the receiver 22 would detect the same and would pick up its output relay 22-R closing the switch 22-1 and opening the switch 22-2. Since the latch relay 32 remains energized through the switches 32-2 and 26-1 and line 37, the switch 32-1 also remains closed and a power circuit is provided to the railroad signal relay 24 to pick up the same, thus avoiding unnecessary down time of the crossing gate at the subsequent grade crossing 4. When the train starts up again in its original direction of movement, the receiver 22 rapidly will detect such movement and will drop its output relay 22-R closing the switch 22-2 and opening the switch 22-1, whereby the railroad signal relay 24 is dropped again to effect operation of the indicator device 25.

As the back wheels of the train leave the island 13 at the first grade crossing 3, the receiver 12 will again receive the first track signal from the transmitter 11 to effect energization or pick up of the railroad signal relay 14 stopping the production of a warning signal at the first grade crossing 3. Similarly, after the rear wheels of the train pass the tie point of the repeater receiver 26 of the track 2, i.e., the train leaves the island 26*a*, the repeater receiver also will receive the first track signal from the transmitter 11 and will pick up its output relay 26-R to throw the switch arm 33 into engagement with the upper contact 34 of the switch 26-1. Shortly afterwards, when the rear wheels of the train have left the island 23, the receiver 22 will pick up its output relay 22-R closing the switch 22-1 to pick up the railroad signal relay 24 and opening the switch 22-2 to drop the latch relay 32. Therefore, the picked up railroad signal relay 24 will eliminate production of a warning signal at the subsequent grade crossing 4, and the open latch switches 32-1 and 32-2 will ensure that the logic circuit 27 is again conditioned for operation in response to first motion detection of another train approaching from the left by either the repeater receiver 26 or the receiver 22.

Figure 3:
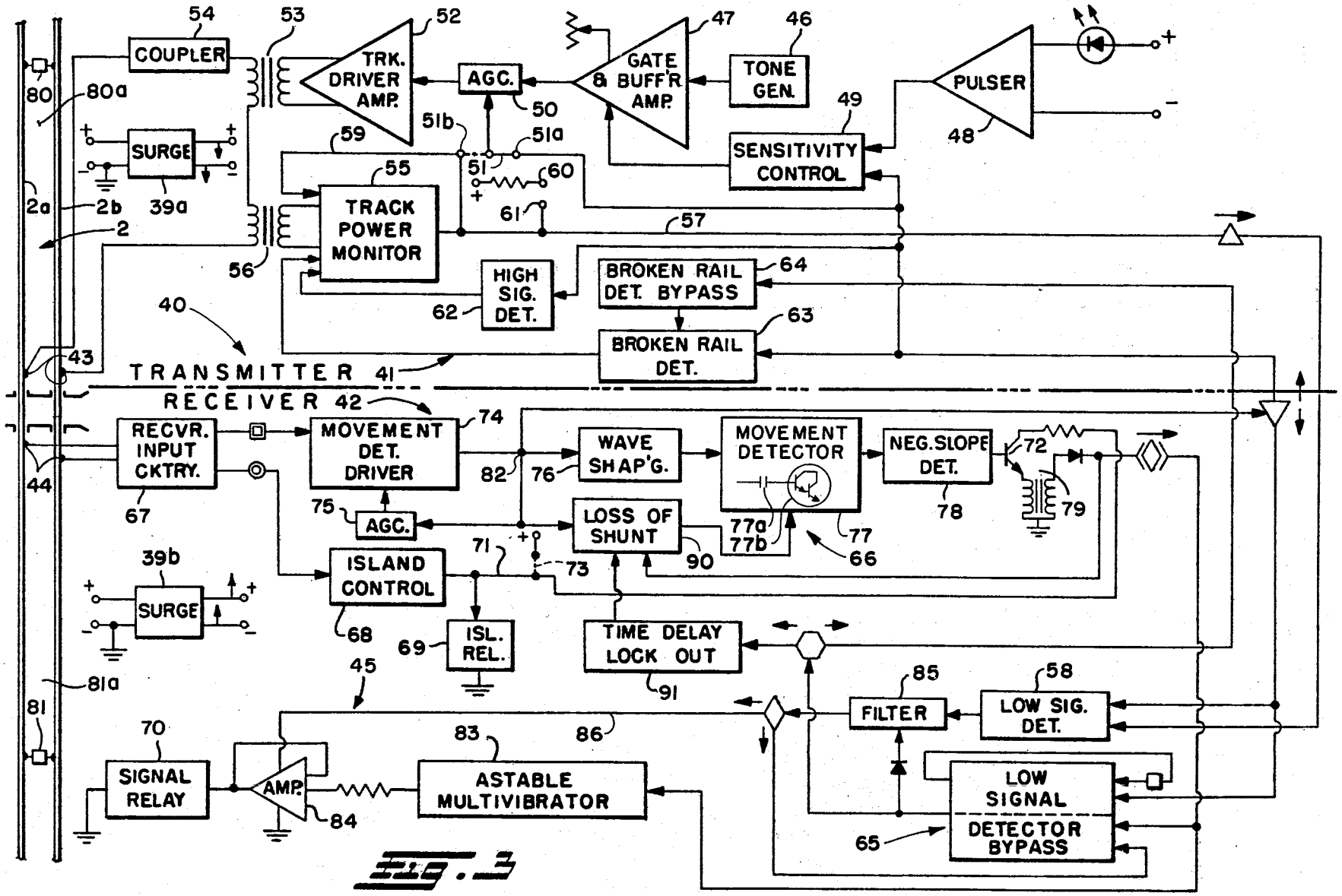
FIG. 3 is a schematic circuit diagram of a transmitter-receiver device used in the system shown in FIG. 1.

Referring now more particularly to FIG. 3, a transmitter-receiver device which is typical of the transmitter-receiver devices 10, 20, is generally indicated at 40. The elements of the transmitter-receiver device 40 are disclosed in detail specifically in my co-pending U.S. Patent Application for "Improved Railway Signal System", Ser. No. 568,565, Filed Apr. 16, 1975, as well as in my other above-mentioned copending U.S. Patent Application and U.S. Patent. The transmitter-receiver device 40 includes a transmitter 41 and a receiver 42.

Figures 3, 4, 5:
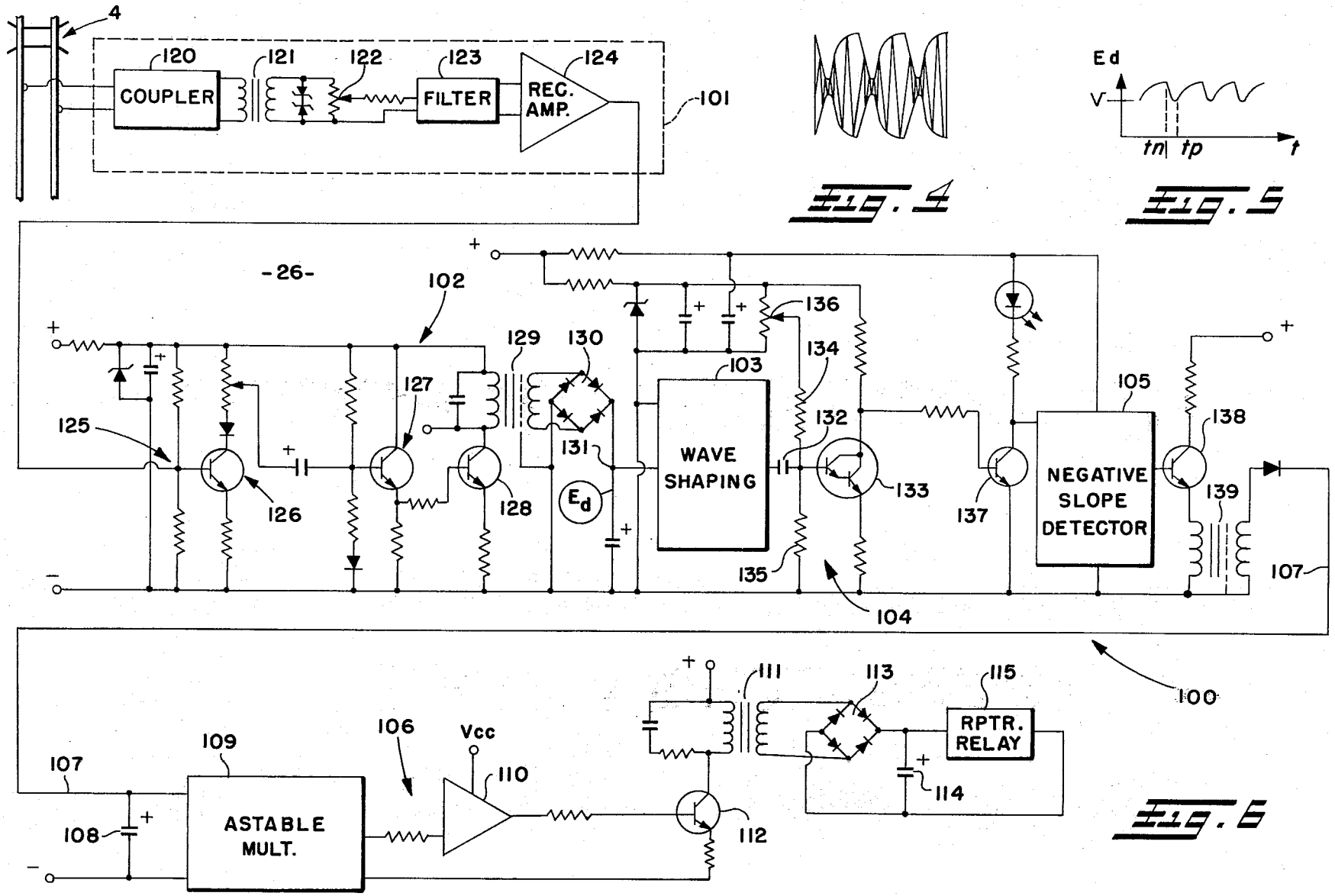
FIG. 4 is a graph of a typical interrupted or pulse modulated AC carrier wave signal generated by the transmitter of the railroad signal system for application to the track as the track signal.
FIG. 5 is a graph of a typical control signal developed in the motion detecting portion of each of the receivers and repeater receivers, referred to below as the shaped $E_d$ signal, which includes a DC voltage with an impressed AC pulse, both being proportionally representative of the track signal received by the respective receivers and repeater receivers.

The transmitter 41 generates or develops an interrupted or pulse modulated AC carrier wave signal, which is coupled for transmissions as a track signal in the rails 2*a*, 2*b* of the track 2 at the transmitter tie point 43 to the track, and the receiver 42 tied to the track at 44 responds to the track signal, changes therein or loss thereof to produce respective system output signals at an output circuit portion 45 indicative of whether or not an approaching train has been detected. A typical interrupted AC carrier wave signal produced by the transmitter 41 is illustrated in FIG. 4, and preferably the only difference between the transmitter-receiver devices 10 and 20 is in the respective frequencies of the AC carrier wave signals developed in the respective transmitters 11, 21 and to which the respective receivers 12, 22 respond.

DC power to the indicated terminals and various components for the transmitter 41 and receiver 42 is supplied from a DC supply, not shown, via respective surge protection circuits 39*a*, 39*b*.

In developing the interrupted AC carrier wave signal in the transmitter 41, a fixed frequency AC carrier wave signal generated in a tone generator 46 is combined in a gate and buffer amplifier 47 with an interrupting or modulating signal generated in a pulser 48. The modulating signal is supplied to the gate and buffer amplifier 47 via a sensitivity control 49, which determines the percent modulation of the AC carrier wave signal in response to the $E_d$ control voltage developed in the receiver 42 proportional to the received track signal voltage. The gate and buffer amplifier supplies the raw interrupted AC carrier wave signal, which is illustrated in FIG. 4, via an automatic gain control 50, which may attenuate that signal in response to track signal voltage or track current depending on whether jumper 51 is connected to the terminal 51*a* or 51*b*, to the track driver amplifier 52. The amplified interrupted AC carrier wave signal output from the track driver amplifier 52 is coupled via a transformer 53 and an impedance matching coupler circuit 54 to the track 2 at tie point 43 for transmission in the track as the track signal.

A track power monitor 55 monitors the interrupted AC carrier wave signal supplied to the track via a coupling transformer 56, and the output from the track power monitor on line 57 is supplied to a low signal detector 58 in the receiver 42. A firm lock-out feedback circuit 59 is provided the track power monitor 55 so that upon a temporary loss of the interrupted AC carrier wave signal, which will cause the track power monitor output to go to zero, the track power monitor then would not be able to restart to produce other than a zero output signal until the terminals 60, 61 are briefly jumped. The track power monitor 55 also may be controlled to produce a zero output signal and the mentioned firm lock-out in response to the high signal detector 62 detecting an unreasonably high $E_d$ voltage, which as is mentioned above is proportional to the track signal voltage received at the receiver tie point 44, or detection of a broken rail by the broken rail detector 63.

Thus, when either the interrupted AC carrier wave signal is briefly terminated, for example due to a fault in the transmitter 41, a high signal is detected or a broken rail is detected, the track power monitor 55 will provide a firm lock-out function via the low signal detector 58 to ensure production of a system output signal at the output circuit portion 45 indicative of detection of an approaching train, as will be further described. This system output signal will continue until the unsatisfactory condition is corrected and the terminals 60, 61 are briefly connected.

A broken rail detector bypass circuit 64 disables the broken rail detector 63 upon production of the trigger signall by the low signal detector bypass circuit 65 when the motion detecting portion 66 of the receiver 42 detects the motion of an approaching train before the low signal detector 58 has detected a low track signal.

In the receiver 42 a receiver input circuit 67, which may include an impedance matching circuit, a highly selective filter, a transformer, and surge protection equipment, provides the received track signal to an island control circuit 68, which may be simply an amplifier that provides an output to pick-up a separate island relay 69 when no train is in the island between the system tie points 43, 44 to the track 2 or to drop the island relay when a train is located in the island. The island relay 69 may be used to operate switch contacts connected in series with the receiver output relay 70 or in series with switch contacts of the output relay, which may be the same as the railroad signal relay 14 or the receiver output relay 22-R identified above in FIG. 1. The output line 71 from the island control 68 may be connected to supply $V_{cc}$ power to an output transistor 72 in the motion detection portion 66 of the receiver 42, or that $V_{cc}$ power may be supplied by connecting a jumper 73 so as to bypass the affect of the island control circuit 68 by supplying constant $V_{cc}$ power to transistor 72.

The receiver input circuit 67 also supplied a signal to the movement detector driver amplifier 74 at the input of the motion detecting portion 66. The output from the movement detector driver is the above-mentioned unfiltered and unshaped $E_d$ voltage, which may be fed back to the movement detector driver via an automatic gain control 75 for regulation thereof.

The $E_d$ voltage is filtered and shaped in a wave shaping circuit 76 and is supplied from the latter in the form of a DC voltage having an impressed proportional AC pulse, as is shown in FIG. 5, to a movement detector 77, which includes a high gain transistor amplifier and a differentiating or blocking capacitor at the base or control input of that transistor amplifier. The output from the movement detector 77 is coupled to a negative slope detector 78 for noise immunity and for reducing ring-by time, and the output from the negative slope detector drives the power transistor 72 to produce an AC output signal in the secondary of the coupling transformer 79 when $V_{cc}$ power is supplied on the line 71, and no train has been detected by the movement detector.

The operation of the motion detecting portion 66 is described in detail in my above-identified U.S. Patent and co-pending U.S. Patent Applications. Briefly described, however, in operation of the motion detecting portion 66 and the AC signal received from the receiver input circuit 67 when a train is not present in the island is amplified in the movement detector driver 74, and the output therefrom is transformed, rectified and shaped before being provided as the filtered and shaped $E_d$ signal to the input differentiating capacitor in the movement detector 77. In an exemplary embodiment of the invention, when no train has been detected on the track 2 within the range of track through which the track signal is effectively transmitted, the shaped $E_d$ signal preferably is a 40 volt DC level v, shown in FIG. 5, with a proportional 2.5 volt peak-to-peak impressed pulse.

Beginning of approach shunts 80, 81 may be used to define accurately the length of the monitored approaches 80*a* to the island. The beginning of approach shunts may be mostly conductive, such as a hard wire, when the short circuiting of other track signals is of no concern, or they may be filtering to avoid affecting any of the signals in the track except for the desired track signal of the railroad signal system 50.

When a train approaches the island within the range of the transmitted track signal, it provides a shunting affect across the track rails and reduces the effective track ballast seen by the transmitter 41 whereby the track signal voltage received at the receiver 42 also begins to decrease. The $E_d$ voltage and the proportional pulse are therefore reduced in magnitudes as the train continues to approach the island, such reduction generally being logarithmic with respect to the train distance from the island.

The input differentiating capacitor 77*a* normally blocks the DC part of the $E_d$ signal and provides through the pulses impressed on such DC part a constant self-checking of the system 40, for example, at a rate of approximately 5 times per second, depending on the frequency of the modulating signal produced by the pulser 48. The capacitor 77*a* may be considered in a zero or charged state, that is it charges back to zero state condition at a constant charging rate. Thus, each time an $E_d$ pulse goes in a negative direction, for example, beginning at time $t_n$ in FIG. 5, simulated motion is detected by the movement detector 77 and the amplifier 77*b* thereof is cut off; and as the pulse recovers in the positive direction, for example beginning at time $t_p$ in FIG. 5, the capacitor 77*a* recharges and the amplifier 77*b* conducts. When a continued slow drop of the DC part of the $E_d$ signal occurs, for example, due to a slowly approaching train far from the island, the capacitor 77*a* maintains itself only a slight amount away from the zero state, drawing very little current from its recharging circuit, not shown, but which is a base biasing network of the amplifier 77*b*, and the $E_d$ pulses will effect an AC output from the amplifier 77*b*.

A train on the track 2 traveling toward the island is a traveling shunt that reduces the track signal voltage as well as the pre-shaped $E_d$ signal at the node 82, such signal reductions being generally non-linear with respect to train distance from the island due to the non-linearity of the accumulated track ballast in the approach. Although it has been found that signals having frequencies from 20 to 65 Hz exhibit some semblance of linearity of attenuation over a given length of track, higher frequency signals, say from 300 to 3000 Hz, are substantially non-linear over the entire approach.

In the mentioned embodiment when the DC part of the $E_d$ signal is at 40 volts with a 2.5 volt pulse, an approaching train causing a drop in the $E_d$ signal in excess of approximately 0.4 volt per second will bias the amplifier 77*b* to cut off preventing it from passing the pulses through the succeeding stages of the motion detecting portion 66 with the result that no positive signal is provided at the secondary of the coupling transformer 79. Therefore, there will be no power input signal to the astable multivibrator 83 in the output circuit portion 45 of the receiver 42, and the amplifier 84 will not be driven. Accordingly, the output relay 70 will be dropped. Similarly, when the shaped $E_d$ signal is at 20 volts with a 1.25 volt pulse, a 0.2 volt per second drop in the DC part will maintain the amplifier 77*b* cut off. Once the amplifier 77*b* is cut off, the traveling shunt affect of the approaching train maintains the amplifier 77*b* cut off due to a containing $E_d$ drop at a rate faster than the pulses effectively rise, and since the capacitor 77*a* cannot recharge instantaneously, the base of the amplifier 77*b* is effectively held negative.

The transmitter-receiver device 40 of the railroad signal system 1 becomes increasingly more sensitive to $E_d$ drop as the train approaches the island because the $E_d$ pulses require less of an overall $E_d$ drop to bias the amplifier 77*b* to cut off. Moreover, since the track ballast impedance is usually seen as a non-linear impedance, a train 3000 feet from the island must effect, for example, a reduction of the $E_d$ signal at a rate of approximately 0.4 volt per second for the motion detecting portion 66 to detect the motion of such approaching train; whereas a train only several hundred feet from the island need only effect a reduction of the $E_d$ signal at a rate of approximately 0.011 volt per second for detection of the motion thereof. Therefore, briefly referring to FIG. 1 again, after a train has entered the track area between the two grade crossings 3 and 4, the receiver 22 will be highly sensitive to detect the motion of an approaching train.

An AC output signal from the movement detector 77 will effect cut off of a normally saturated active transistor in the negative slope detector 78 when such AC output signal is in its negatively sloped position. The output from the negative slope detector is, therefore, generally in the form of a square wave that drives the coupling transformer 79 via the power transistor 72. Since the negative slope detector 78 is operated alternatively at saturation and at cut off, it is relatively immune to noise and provides circuit isolation and uniform regulation of the position signal supplied to the astable multivibrator 80 as well as to the low signal detector bypass 65, further described below.

The low signal detector 58 monitors both the output from the track power monitor 55 and the unshaped $E_d$ signal appearing at the node 82 at the output of the movement detector driver 74. When a zero output signal is produced on the output line 57 from the track power monitor 55, or when the track signal voltage as reflected in the $E_d$ voltage, drops below a predetermined level set in the low signal detector 58, the latter will cut off power normally provided via filter 85 on the line 86 to the $V_{cc}$ supply for amplifier 84, thus causing the output relay 70 to be dropped. The low signal detector may be bypassed under certain conditions, as described in detail in my Patent application Ser. No. 568,565, by the low signal detector bypass 65.

A loss of shunt circuit 90 also receives an input from the output of the movement detector driver 74 to prevent loss of motion detection by the movement detector 77 in the event an already detected approaching train briefly bounces or passes over a short length of rusty rail. Moreover, a time delay lock-out circuit 91, which acts on the movement detector 77 via the loss of shunt circuit 90, ensures that for a period of time after the movement detector 77 has detected an approaching train, it will continue to maintain an output indicative of such detection. The time delay lock-out circuit 91 therefore eliminates the nuisance of repetitive detection and loss of detection of the motion of an approaching train which may be relatively remote from the island.

From the foregoing summary description of the transmitter-receiver device 40, the construction and operation of the transmitter-receiver devices 10 and 20 described above with reference to FIG. 1 should now be clear. It is to be understood, however, that the transmitter-receiver devices 10 and 20 may be other types of transmitter-receiver devices that respond to changes in the track signal caused by the moving shunt affect of an approaching train which changes the effective lumped track ballast or impedance. Such transmitter-receiver movement detector systems, for example, are disclosed in my above-mentioned patent and patent applications and are described in greater detail therein.

Turning now more particularly to FIG. 6, the schematic electric circuit of the repeater receiver 26 is generally indicated at 100 receiving DC power at the indicated terminals and the respective components from a supply, not shown. The repeater receiver 26 includes an input circuit 101, a movement detector driver circuit 102, a wave shaping circuit 103, a movement detector circuit 104, a negative slope detector 105, and an output circuit portion 106, each of which preferably is similar to corresponding elements contained in the receiver 42 described above with reference to FIG. 3. The repeater receiver 26 is coupled to the track proximate the subsequent grade crossing 4, and if the motion of an approaching train has not been detected by the repeater receiver, a rectified AC signal will be supplied on the line 107 to the smoothing capacitor 108 input to the astable multivibrator 109 in the output circuit portion 106. Upon receiving such a power input, the astable multivibrator 109 will produce an AC output signal that is amplified in the voltage follower amplifier 110 which in turn drives a coupling transformer 111 via a power transistor 112. The output from the transformer 111 is full wave rectified by a bridge 113, the output from which is smoothed or filtered by a capacitor 114, and that smoothed signal effects energization or pick up of the repeater receiver output relay 115 which, as described above, may be repeater output relay 26-R shown in FIG. 1 or may be the railroad signal relay itself if no logic circuit, such as the logic circuit 27, is used. If the motion of an approaching train has been detected by the repeater receiver 26 or if a train is located in the island 26*a*, a zero signal will be produced on the line 107 whereby the astable multivibrator 109 will not produce an AC output signal. Therefore, no signal will be coupled through the transformer 111 and the repeater receiver output relay 115 will be dropped.

The repeater receiver input circuit 101 includes an impedance matching coupler circuit 120, a transformer 121, a potentiometer 122, a highly selective filter 123, for example, tuned to the frequency of the AC carrier wave signal developed in the transmitter 11, and a receiver amplifier 124. The input circuit 101 supplies a signal to the input 125 of a pair of AC coupled amplifier stages 126, 127 in the movement detector driver 102. A power transistor 128 is driven by the latter amplifier stage 127, and the power transistor 128 in turn drives a transformer 129. When the repeater receiver 26 receives a track signal, an AC signal induced in the secondary of the transformer 129 is rectified by a full wave bridge rectifier 130 to develop the unshaped $E_d$ control signal at the node 131, as described above, for example, with reference to the receiver 42 of FIG. 3.

The wave shaping circuit 103 provides a shaped $E_d$ signal to the blocking or differentiating capacitor 132 in the input to the high gain Darlington pair transistor amplifier 133 in the movement detector 104. The base bias circuit for the amplifier 133 includes a pair of resistors 134, 135 and an adjustable potentiometer 136, which may be ajdusted to vary the effective gain of the amplifier 132, and, particularly, the sensitivity of the repeater receiver 26. Normally the potentiometer 136 is adjusted to provide maximum voltage to the resistors 134, 135 effecting minimum sensitivity of the motion detecting portion 104. If it were desired to provide a longer warning time before a train arrives at the subsequent crossing 4, the potentiometer 136 may be turned down to reduce the voltage to the resistors 134, 135 and, thus, the normal bias on the amplifier 133. Therefore, the amplifier 133 may be cut off by a smaller than 0.4 volt per second drop rate in the $E_d$ voltage when such voltage is at about the 40 volt, maximum level.

The collector output from the amplifier 133 is coupled by a buffer transistor amplifier stage 137 to the input of the negative slope detector 105, the output from which drives a power transistor 138. When the amplifier 133 produces an AC output, the power transistor 138 drives a coupling transformer 139 to provide the above-mentioned rectified signal on the line 107 indicating that the repeater receiver 26 has not detected an approaching train. When the amplifier 133 is cut off, there is no signal transmitter through the transformer 139.

The detailed operation of the repeater receiver 26 shown in FIG. 6 will be described hereninafter with reference to the connection thereof in the railroad signal system 1 described above with reference to FIG. 1. The track section or island 26*a* between the tie points of the transmitter 11 and the repeater receiver 26 is similar to the island 13 at the first grade crossing 3, for example. Moreover, the operation of the repeater receiver 26 and its cooperation with the transmitter 11 are substantially identical to the operation of the transmitter-receiver device 10, wherein the receiver 12 cooperates with the transmitter 11.

Accordingly, the transmitter 11 transmits an interrupted AC carrier wave signal in the track 2 which track signal travels down the track in both directions. The gain of the repeater receiver 26 is turned up to a relatively high level with respect to the gain of the receiver 22, for example, by adjustment of the potentiometer 122 in the input circuit 101 and/or the potentiometer 140 in the input 125 to the transistor amplifier stage 126 in the movement detector drivers 102. Such a high gain eliminates the affect of the impedance of the island 26*a* and enables the repeater receiver 26 to pick up and to respond to the track signal transmitted by the transmitter 11, even if a relatively large amount of attenuation of that signal is caused by an unfavorable ballast condition at the grade crossing 3. More particularly, the repeater receiver gain is adjusted to maintain a normal about 40 volt $E_d$ level when no train has entered the approach monitored thereby. Also, the sensitivity potentiometer 136 is adjusted to ensure effective train detection safely in advance of its arrival at the subsequent crossing 4.

An approaching train on the track 2 within the section of the track monitored by the repeater receiver 26 is a traveling shunt that reduces the track signal from the transmitter 11 as well as the preshaped $E_d$ signal at the node 131. Such signal reductions are generally non-linear with respect to train distance from the transmitter tie points to the track due to the non-linearity of the accumulated track ballast impedance in the monitored approach.

When there is no train within the track length or approach monitored by the railroad signal system 1, the repeater receiver input circuit 101 amplifies the received track signal and supplies the same to the input of the movement detector driver 102. The movement detector driver 102 then further amplifies the received signal and the $E_d$ voltage is developed at the node 131. The $E_d$ voltage is shaped in the wave shaping circuit 103 and is then provided as the shaped $E_d$ signal to the capacitor 132. Preferably the shaped $E_d$ signal has a 40 volt DC level v, as shown in FIG. 5, and a proportional 2.5 volt peak-to-peak impressed pulse. The capacitor 132 normally blocks the DC part of the $E_d$ signal and provides through the pulses impressed on such DC part a constant self-checking of the railroad signal system at a rate of approximately 5 times per second, depending on the frequency of the pulses produced by the pulser 48 in the transmitter 11. The capacitor 132 may be considered in a zero or charged state, i.e., it charges back to zero state condition at a constant charging rate. Thus, each time an $E_d$ pulse goes in a negative direction, e.g. beginning at time $t_n$ in FIG. 4, simulated motion is detected by the movement detector 104, and the amplifier 133 is cut off; and as the pulse recovers in the positive direction, e.g. beginning at time $t_p$ in FIG. 5, the capacitor 132 recharges and the amplifier 133 conducts. When a continued slow drop of the DC part of the $E_d$ signal occurs, for example, due to a relatively slowly approaching train far from the tie point of the transmitter 11 to the track 2, the differentiating capacitor 132 maintains itself only a slight amount away from the zero state, drawing very little current from its recharging circuit, which is the base biasing network of the amplifier 133, including the resistors 134, 135 and the potentiometer 136, and the $E_d$ pulses will effect an AC output from the amplifier 133.

The collector output from the transistor amplifier 133 is coupled by the buffering transistor 137 to the negative slope detector 105. The negative slope detector 105 includes a normally saturated active transistor, which is cut off when the AC output signal from the movement detector 104 is in its negatively sloped portion. The output from the negative slope detector 105, therefore, is generally in the form of a square wave that drives the power transistor amplifier 138 with relative noise immunity.

In the preferred embodiment of the invention, and particularly in the repeater receiver 26, when the DC part of the shaped $E_d$ signal supplied to the capacitor 132 is at 40 volts with a 2.5 volts pulse, an approaching train causing a drop in the $E_d$ signal in excess of approximately 0.4 volt per second will bias the amplifier 133 to cut off preventing it from passing the pulses through the succeeding stage of the motion detecting portion 104 with the result that no positive signal is provided on the line 107. Therefore, the repeater relay 115 will drop. Similarly, when the shaped $E_d$ signal is at 20 volts with a 1.25 volt pulse, a 0.2 volt per second drop in the DC part normally will maintain the amplifier 133 cut off, depending on the sensitivity adjustment at the potentiometer 136. Once the amplifier 133 is cut off, the traveling shunt affect of the approaching train maintains the amplifier 133 cut off due to a containing $E_d$ drop at a rate faster than the pulses effectively rise, and since the capacitor 132 cannot recharge instantaneously the base of the amplifier 133 is effectively held negative. In the same manner as described above, the repeater receiver 26 becomes increasingly sensitive to the motion of an approaching train and the continuing $E_d$ drop as a train approaches closer to the tie points of the transmitter 11 to the track 2. Of course, when the leading wheels of the train enter the island 26*a* no signal reaches the repeater receiver 26, and as described in my above-mentioned patent and patent applications, when the trailing train wheels leave the island 26*a* the repeater receiver will rapidly recover.

Since the grade crossing 3 is located quite proximate the transmitter 11, an unfavorable ballast condition at the grade crossing 3 will not appreciably adversely affect the ability of the repeater 26 to detect an approaching train. Moreover, since the first grade crossing 3 is preferably located within the island 26*a* between the tie points of the transmitter 11 and the repeater receiver 26 to the track 2, an unfavorable ballast condition at the first grade crossing will not affect the ability of the repeater receiver 26 to look beyond the transmitter 11 to detect the motion of an approaching train.

As has been mentioned briefly above, the further repeater receiver 5 may be coupled to the track 2 proximate the first grade crossing 3 in order to detect a train approaching from the right beyond the subsequent grade crossing 4. When using such a further repeater receiver 5, a further logic circuit 6, similar to the logic circuit 27 described in detail with reference to FIG. 2, would be coupled, as shown in the dotted connections in FIG. 1, to combine the output signals from the further repeater receiver 5 and the receiver 12, and the direct connection between the receiver 12 and the relay 14 would be eliminated.

The embodiments of the invention in which an exclusive property or privilege is claimed are defined as follows:

1. A railroad signal system for detecting a train approaching at least two spaced apart locations, comprising transmitter-receiver means for detecting a train approaching a first one of the locations, including transmitter means for developing a first signal, and receiver means for detecting such an approaching train in response to changes in such first signal representative of the approaching train speed and distance from such first location; and repeater receiver means between such locations for looking through such first location even under unfavorable ballast conditions for detecting such an approaching train in response to changes in such first signal representative of the approaching train speed and distance from a subsequent one of the locations.

2. A railroad signal system as set forth in claim 1, said transmitter means comprising means for transmitting such first signal as an interrupted carrier wave; and said repeater receiver means comprising means for producing from such received interrupted carrier wave a signal normally having DC and AC parts, amplifier means for producing from an input signal a corresponding output signal, and differentiating capacitor means in the input to said amplifier means for normally blocking such DC part and passing thereto such AC part of such signal, an AC output from said amplifier means being indicative of no approaching train and a DC output from said amplifier means caused by a drop in the level of such DC part at a rate at least approximately equal to the rate at which such AC part increases being indicative of detection of an approaching train.

3. A railroad signal system as set forth in claim 2, wherein said means for producing comprises a resistance and capacitor wave shaping circuit.

4. A railroad signal system as set forth in claim 2, said repeater receiver means further comprising a normally saturated negative slope detector means coupled to the output of said amplifier means for producing an AC output signal when a portion of such corresponding output signal is negatively sloped.

5. A railroad signal system as set forth in claim 2, said means responsive comprising an astable multivibrator means for producing an AC output signal when said amplifier means produces an AC output.

6. A railroad signal system as set forth in claim 2, said repeater receiver means comprising input filter means for receiving only such first interrupted carrier wave.

7. A railroad signal system as set forth in claim 2, said repeater receiver means further comprising gain adjusting means for adjusting the gain of said amplifier means and thus the sensitivity of said repeater receiver means.

8. A railroad signal system as set forth in claim 1, said repeater receiver means including gain adjustment means for varying the gain thereof at least to reduce the attenuation affect of such unfavorable ballast condition on such first signal.

9. A railroad signal system as set forth in claim 1, comprising further transmitter-receiver means for detecting a train approaching such subsequent location, including further transmitter means for developing a second signal, the further receiver means for detecting such an approaching train in response to changes in such second signal representative of the approaching train speed and distance from such subsequent location; and output means for producing an output indicative of an approaching train when at least one of said repeater receiver means or said further receiver means first detects an approaching train.

10. A railroad signal system as set forth in claim 9, said transmitter means comprising means for transmitting such first signal as an interrupted carrier wave of a first frequency; and said further transmitter means comprising further means for transmitting such second signal as an interrupted carrier wave of a second frequency; said repeater receiver means being responsive only to such first frequency and said further receiver means being responsive only to such second frequency.

11. A railroad signal system as set forth in claim 9, said output means comprising logic circuit means for bypassing the affect of said repeater receiver means on said output means upon detection of a train by said further receiver means until such detection is terminated.

12. A railroad signal system as set forth in claim 11, said logic circuit means comprising latch means operable upon detection of a train by said further receiver means to effect such bypass.

13. A railroad signal system as set forth in claim 12, further comprising switch means for affecting production of such output indicative of an approaching train upon detection thereof by said repeater receiver means; and said latch means comprising bypass means for bypassing said switch means when said latch means is energized.

14. A railroad signal system as set forth in claim 13, said logic circuit means comprising further switch means responsive to the detecting of an approaching train by said further receiver means for energizing said latch means and for effecting production of such output indicative of an approaching train.

15. A railroad signal system as set forth in claim 14, said first-mentioned switch means comprising a single pole double throw switch means for conditioning a self-energizing circuit for said latch means when said repeater receiver means detects an approaching train.

16. A railroad signal system as set forth in claim 14, each of said mentioned switch means comprising relay operated switch means.

17. A railroad signal system as set forth in claim 9, said transmitter means comprising means for transmitting such first signal as an interrupted carrier wave of a first frequency; said further transmitter means comprising means for transmitting such second signal as an interrupted carrier wave of a second frequency; said receiver means and said repeater receiver means each respectively comprising input filter means for passing at least substantially only a signal having such first frequency, means for receiving such passed interrupted carrier wave of such first frequency, and means responsive to an output from said means for receiving for providing an indication of an approaching train, said means for receiving including means for producing from such passed interrupted carrier wave of such first frequency a signal normally having DC and AC parts, amplifier means for producing from an input signal a corresponding output signal, and differentiating capacitor means in the input to said amplifier means for normally blocking said DC part and passing thereto said AC part of such signal, an AC output from said amplifier means coupled to said means responsive being indicative of no approaching train and a DC output from said amplifier means caused by a drop in the level of said DC part at a rate at least approximately equal to the rate at which said AC part increases being indicative of detection of an approaching train.

18. A railroad signal system as set forth in claim 17, said further receiver means comprising input filter means for passing at least substantially only a signal having such second frequency, means for receiving such passed interrupted carrier wave of such second frequency, and means responsive to an output from said means for receiving for providing an indication of an approaching train, said means for receiving including means for producing from such passed interrupted carrier wave of such second frequency a signal normally having DC and AC parts, amplifier means for producing from an input signal a corresponding output signal, and differentiating capacitor means in the input to said amplifier means for normally blocking said DC part and passing thereto said AC part of such signal, an AC output from said amplifier means coupled to said means responsive being indicative of no approaching train and a DC output from said amplifier means caused by a drop in the level of said DC part at a rate at least approximately equal to the rate at which said AC part increased being indicative of detection of an approaching train.

* * * * *

UNITED STATES PATENT OFFICE
CERTIFICATE OF CORRECTION

PATENT NO. : 3,974,991
DATED : August 17, 1976
INVENTOR(S) : Willard L. Geiger

It is certified that error appears in the above-identified patent and that said Letters Patent are hereby corrected as shown below:

Claim 9, Column 19, line 34, change "the" to --and--.

Claim 18, Column 20, line 64, change "increased" to --increases--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*